US007407451B2

(12) United States Patent
Velasquez

(10) Patent No.: US 7,407,451 B2
(45) Date of Patent: Aug. 5, 2008

(54) LACROSSE TRAINING DEVICE

(76) Inventor: Matthew J. Velasquez, 200 Heidenrich Dr., Tewksbury, MA (US) 01876

( * ) Notice: Subject to any disclaimer, the term of this patent is extended or adjusted under 35 U.S.C. 154(b) by 207 days.

(21) Appl. No.: 11/035,469

(22) Filed: Jan. 14, 2005

(65) Prior Publication Data

US 2006/0154755 A1 Jul. 13, 2006

Related U.S. Application Data

(60) Provisional application No. 60/643,047, filed on Jan. 11, 2005.

(51) Int. Cl.
*A63B 69/00* (2006.01)

(52) U.S. Cl. ..... 473/422; 473/513; D21/724

(58) Field of Classification Search ..... 473/512, 473/513, 505, 422; D21/726, 724
See application file for complete search history.

(56) References Cited

U.S. PATENT DOCUMENTS 3,330,560 A * 7/1967 Higdon ..... 473/437
3,490,766 A * 1/1970 Gardner ..... 482/105
3,525,141 A * 8/1970 Smith ..... 29/428
3,834,697 A * 9/1974 McNamara et al. ..... 473/256
3,913,911 A * 10/1975 Peterson ..... 473/519
4,000,893 A * 1/1977 Evans ..... 473/437
4,040,632 A * 8/1977 Pawl ..... 473/213
4,052,061 A * 10/1977 Stewart ..... 473/437
4,142,721 A * 3/1979 Faleck et al. ..... 473/437
4,247,101 A * 1/1981 Gallmeyer ..... 473/63
4,371,983 A * 2/1983 Piotti, Jr. ..... 2/19
4,538,812 A * 9/1985 Mugford et al. ..... 473/437
4,632,389 A * 12/1986 Moss ..... 482/105
5,075,902 A * 12/1991 McReynolds et al. ..... 2/238
5,484,156 A * 1/1996 Giguere ..... 473/256
5,568,925 A * 10/1996 Morrow et al. ..... 473/513
5,980,397 A * 11/1999 Hart et al. ..... 473/437
6,921,347 B1 * 7/2005 Morrow et al. ..... 473/513
7,128,667 B2 * 10/2006 Nolan ..... 473/457
2003/0130070 A1 * 7/2003 Nolan ..... 473/437
2004/0063519 A1 * 4/2004 Liberatore ..... 473/457
2004/0259666 A1 * 12/2004 Bjugstad et al. ..... 473/437

* cited by examiner

*Primary Examiner*—Gene Kim
*Assistant Examiner*—M Chambers
(74) *Attorney, Agent, or Firm*—Sean M. Coughlin; Mintz, Levin, Cohn, Ferris, Glovsky & Popeo, P.C.

(57) ABSTRACT

The invention relates to training devices for sports playing sticks with head frames. More particularly, the invention relates to weighted training devices that may be attached to a playing stick such as a lacrosse stick. The invention includes devices and methods for training and conditioning sports players, particularly lacrosse players.

12 Claims, 4 Drawing Sheets

LACROSSE TRAINING DEVICE

RELATED APPLICATIONS

This application claims the benefit of priority under 35 U.S.C. 119(e) to U.S. Provisional Application No. 60/643,047 now abandoned, filed on Jan. 11, 2005; the entire contents of which is incorporated herein by reference.

FIELD OF THE INVENTION

The invention relates generally to training devices for handheld instruments with head frames. More particularly, the invention relates to weighted training devices that may be attached to a playing stick such as a lacrosse stick.

BACKGROUND OF THE INVENTION

The game of lacrosse is generally considered to be the oldest team contact sport of North American origin. History suggests that lacrosse was played by various Indian tribes as early as the 15th century. The lacrosse stick or "crosse" generally comprises an elongate stick handle or shaft having a butt end and a forward end, with a head frame attached to the forward end. The typical head frame includes a throat portion or shank end portion to which the stick handle is affixed, two sidewalls extending from the throat portion, and a lip portion or transverse wall that is connected to the outer end of a single sidewall or both outer ends of two sidewalls. The head frame supports the flexible netting which defines a ball pocket, traditionally located in the midsection or mouth area of the head. The upper rim of the head frame defines an open mouth through which the lacrosse ball is received into and shot, passed or checked from the lacrosse stick.

During play, the lacrosse ball may be caught by the player in a number of ways, either by scooping a ground ball into the head, or catching a ball in mid-air. In scooping ground balls, the player has to crouch, bend or lean to a greater or lesser extent in order to successfully engage the nose element of the head frame of the stick with the ground and/or ball. During possession of the ball, the player will often spin the stick rapidly about its longitudinal axis to impart centrifugal force to the ball and to aid the player in "cradling" the ball within the pocket of the stick.

Athletes, including lacrosse players, utilize training devices to improve their performance. Weighted training devices are generally used during practice or warm up to strengthen and tone muscles, but in lacrosse, weighted training devices used to work the shoulder, arm, and hand muscles used by the athlete in playing the game—e.g., scooping, throwing, catching, checking—are highly desired.

SUMMARY OF THE INVENTION

Weighted playing sticks, e.g., lacrosse sticks, are available, but those known in the art are dedicated devices and force the athlete to use a stick to which they are not accustomed. The present invention provides a unique solution for those athletes wishing to use their own stick(s), and furthermore which allows them to use their own sticks in actual play or scrimmage if desired.

The invention is directed to a weight training device for a conventional lacrosse stick that can be attached and removed, does not require modification or disassembly of the conventional lacrosse stick, and permits substantially unrestricted use of the conventional lacrosse stick during practice, play, or competition.

In general, in one aspect, the invention provides a training device for a handheld instrument with a head frame including a first weighted member having a defined length and for attachment to a first sidewall of a head frame; a second weighted member having a defined length and for attachment to a second sidewall of the head frame; and attachment means for securing the first and second weighted members to the first and second sidewalls.

Implementations of the training device may include one or more of the following features. The training device can include an interconnecting member joining the first and second weighted members. The interconnecting member can further include attachment means for securing the interconnecting member to a base of the head frame. The training device can be of flexible fabric construction, although other constructions are contemplated and within the scope of the invention. The attachment means can include one or more of straps, clamps, adhesive, buckles, drawstrings, zippers, magnets, or combinations thereof. The attachment means can also include a hook-and-loop strap fastener, although other fasteners are contemplated and within the scope of the invention. The first and second weighted members can comprise a compartment containing a weight. The weight can be approximately less than or equal to one pound in total weight. The weight can be approximately nine ounces in total weight, approximately thirteen ounces in total weight, or within the range of approximately fifteen ounces to sixteen ounces in total weight. The compartment can be of a fabric construction, although other constructions are contemplated and within the scope of the invention. The weight can be one or more metal pieces. The weight can be an aggregate material. The aggregate material can include one or more of gravel, metal shot, metal powder, sand, or combinations thereof. The head frame can be a lacrosse head. The head frame can be a "u"-shaped lacrosse head. The head frame can be a "v"-shaped lacrosse head. The lacrosse head can be removably coupled to a lacrosse shaft. The members can be arranged to provide ready access to an area bounded by the head frame. The defined length of the first and second weighted members can be less than or equal to half the length of the sidewall.

In general, in another aspect, the invention includes a weighted object for attachment to a playing stick, the playing stick having a handle and a head frame, the invention further including a first member coupled to a first sidewall of a head frame of a playing stick; a second member coupled to a second sidewall of the head frame; a third member coupled to a base of the head frame and further coupled to the first member and the second member; where the first member and the second member further include a weighting structure.

Implementations of the weighted object may include one or more of the following features. The members can be removably coupled to the head frame. The members can be removably coupled by one or more straps. The weighting structure can include one or more weights. The weighting structure can include one or more compartments. The one or more weights can be disposed within the one or more compartments. The one or more weights can be removably disposed within the one or more compartments. The one or more weights can comprise a metallic material. The one or more weights can comprise a non-metallic material. The weighted object can be sized and dimensioned such that it does not substantially impede access to an area defined by the head frame. The playing stick can be a lacrosse stick. The first and second members can have a length approximately equal to or less than half the length of the sidewall.

In general, in another aspect, the invention includes a lacrosse training device including a first weighted section engaged to a first long side member of a lacrosse head frame; a second weighted section engaged to a second long side member of the lacrosse head frame; a third section engaged to a base of the lacrosse head frame and coupled to the first and second weighted sections, where the lacrosse training device is sized and shaped to permit substantially unobstructed access to an area defined by the lacrosse head frame.

Implementations of the lacrosse training device can include one or more of the following features. The weighted sections can be releasably engaged to the lacrosse head frame. The sections can be releasably engaged to the lacrosse head frame by one or more straps. The straps can be hook-and-pile straps, although other straps are contemplated and within the scope of the invention. The first and second weighted sections can include one or more compartments for removably containing one or more weights. The one or more weights can be rectangular in shape. The one or more weights can be cylindrical in shape.

In general, in another aspect, the invention includes a lacrosse training system including a lacrosse stick, the lacrosse stick having a handle and a head frame, a training device, the training device configured to permit substantially uninhibited use of the lacrosse stick, and further including one or more weights, one or more compartments; means for removably inserting the one or more weights into the one or more compartments; and means for removably coupling the training device to the lacrosse stick.

In general, in another aspect, the invention includes a method of lacrosse training, including the steps of attaching a training device to a lacrosse stick, the training device comprising one or more weights and configured to permit substantially uninhibited use of the lacrosse stick; and practicing, playing, or competing with the lacrosse stick to which the training device has been attached.

In general, in another aspect, the invention includes a method of weighting a playing stick, the stick having a head frame and a shaft, comprising: attaching to a first and second sidewall of a head frame a device comprising a first and second weighted member joined at a base by an interconnecting member, where the device does not substantially impede ball access to the space defined by the head frame.

In general, in another aspect, the invention includes a method of lacrosse training, comprising the steps of cradling, carrying or playing with a lacrosse stick to which has been attached a device comprising a first and second weighted member joined at the base by an interconnecting member, where the device does not substantially impede ball access to the space defined by the head frame.

Implementations of the invention may provide one ore more the following characteristics. A player can use his or her own lacrosse stick in training or regular play. A player can use a variety of different weights for training.

DETAILED DESCRIPTION OF PREFERRED EMBODIMENTS

Embodiments of the invention provide a weighted training lacrosse stick. Embodiments of the invention can be used for athletic training purposes. Other embodiments are possible and envisioned.

A weighted training device may be used on a sports training device with a head frame. The sports training device may be a lacrosse stick, although other sports training devices having open head frames, e.g., tennis, racquetball, or badminton racquets, are contemplated and within the scope of the invention. The head frame may be a lacrosse head. The lacrosse head may be a man's or boy's lacrosse head, where the base of the lacrosse head is "v"-shaped. Alternatively, the lacrosse head may be a woman's or girl's lacrosse head where the base of the lacrosse head is "u"-shaped. The lacrosse head may further be removably coupled to the lacrosse stick or lacrosse shaft.

Figure 1:
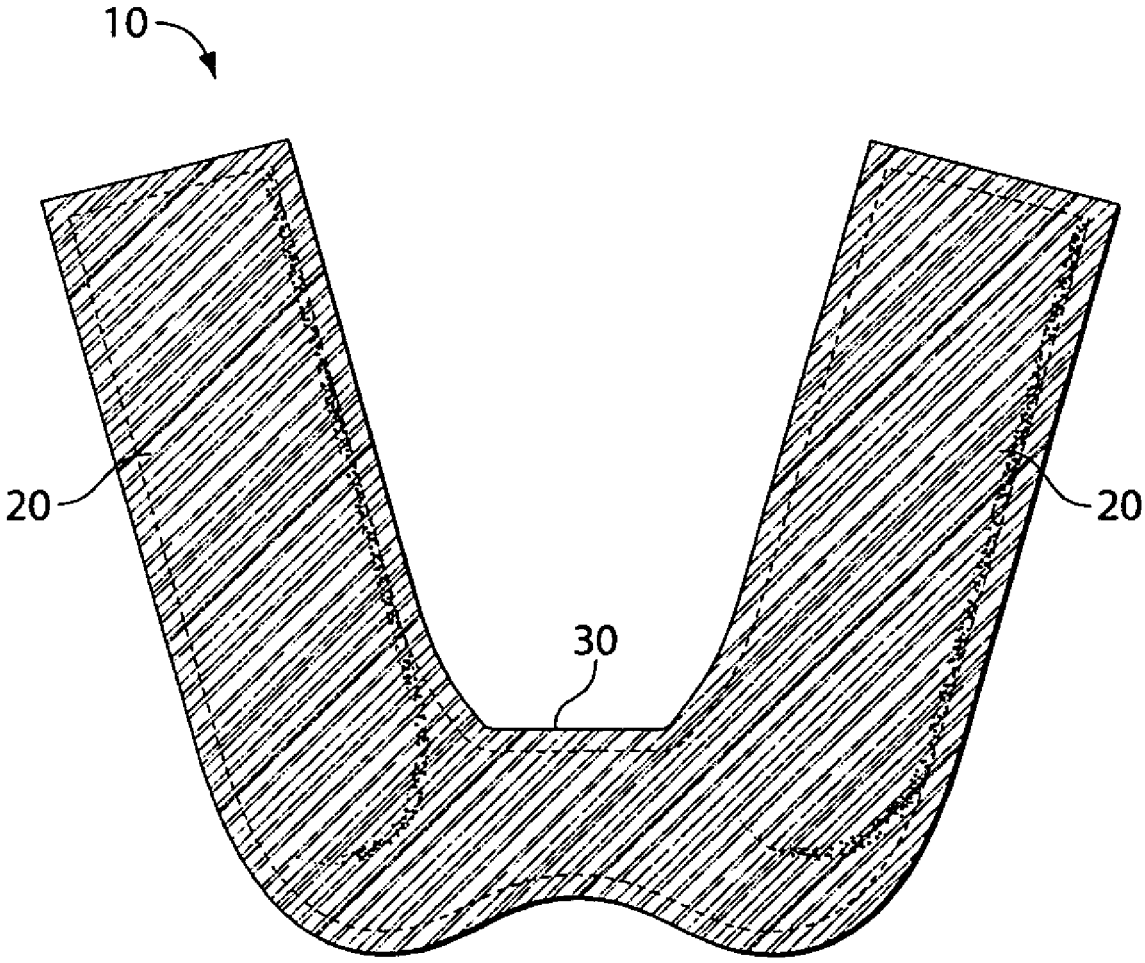
FIG. 1 is a perspective view of a weighted training device of the invention.

Referring to FIG. 1, a weighted training device 10 includes two weighted members 20. The weighted training device 10 may include an interconnecting member 30 joining the weighted members 20. The weighted training device 10 may be constructed of flexible fabric, although other constructions are contemplated and are within the scope of the invention. The weighted members 20 may be of a different construction than the interconnecting member 30.

Figure 2:
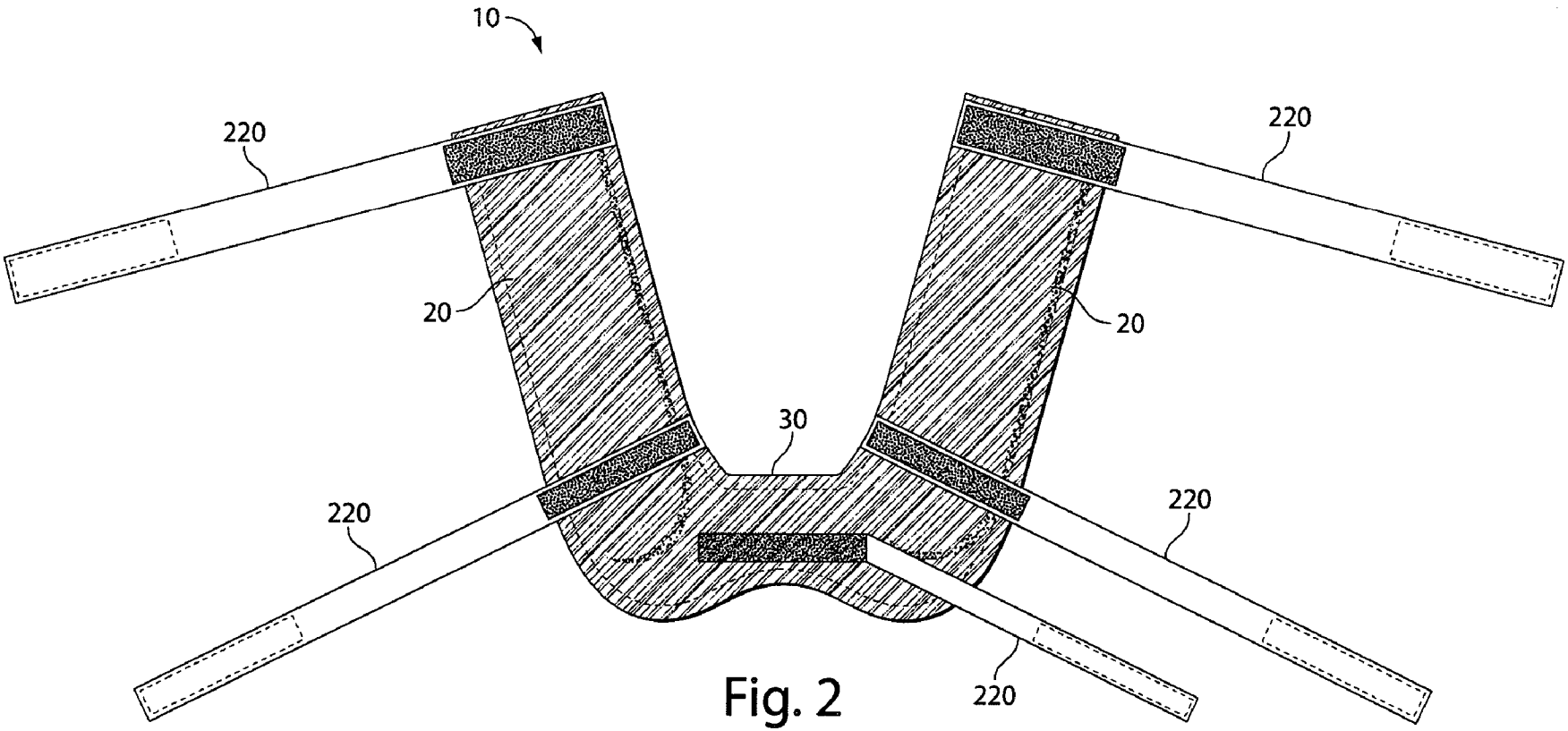
FIG. 2 is a perspective view of another weighted training device of the invention.

Referring to FIG. 2, the weighted training device 10 is shown with straps 220 for attaching the weighted training device 10 to a handheld instrument with a head frame, such as a lacrosse stick. The straps 220 attach the weighted members 20 to a sidewall of the head frame (shown in FIG. 3). The straps 220 are integral to the weighted members 20. Alternatively, the straps 220 may be independent of the weighted members 220. The straps 220 may be a hook-and-loop fastener, although other means of attaching the weighted members 20 to the handheld instrument are contemplated and within the scope of the invention, and may include clamps, adhesive, buckles, drawstrings, zippers, magnets, combinations thereof, or other known means of attachment. Alternatively, the weighted members 20 may be permanently affixed to the head frame. The interconnecting member 30 may be attached to a head frame of a handheld instrument by straps or other means such as clamps, adhesive, buckles, drawstrings, zippers, magnets, combinations thereof, or other known means of attachment. Specifically, the interconnecting member 30 may be attached to the base of the head frame. Alternatively, the interconnecting member 30 may be permanently affixed to the head frame. The weighted training device 10 is adapted for use with a lacrosse stick.

Figure 3:
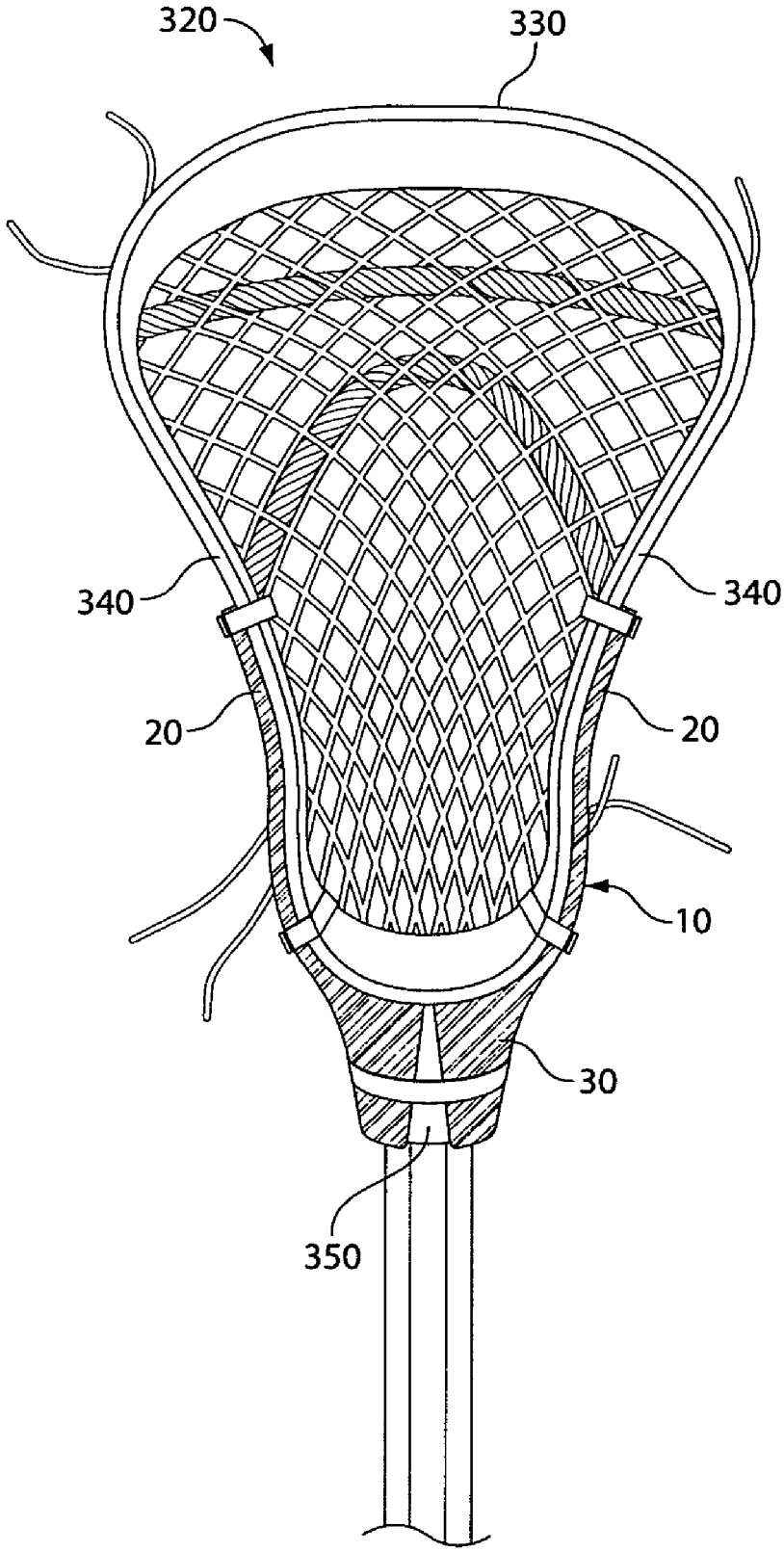
FIG. 3 is a perspective view of a weighted training device of the invention attached to a conventional lacrosse stick.

Referring to FIG. 3, the weighted training device 10 is shown attached to a conventional lacrosse stick 320. The weighted members 20 are attached to the conventional lacrosse stick 320 at head frame 330, and more specifically, to sidewalls 330 of the head frame 330. The interconnecting member 30 is attached to the conventional lacrosse stick 320 at base 350. The weighted members 20 are of a defined length, generally anywhere from two to eight inches in length for an attack/midfield/defense head, and up to about ten inches for a goalie head, where such defined length may be less than or equal to half the length of the sidewall 340. The weighted training device 10 is configured such that access to the area bounded by the head frame is substantially unrestricted.

Continuing with reference to FIG. 3, the weighted members 20 may be configured to encircle or surround the sidewalls 340. Alternatively, the weighted members 20 may be configured such that only a portion of the sidewalls 340 are encircled. Similarly, the interconnecting member 30 may be configured to encircle or completely surround the base 350. Alternatively, the interconnecting member 30 may be configured such that only a portion of the base 350 is encircled.

Figure 4:
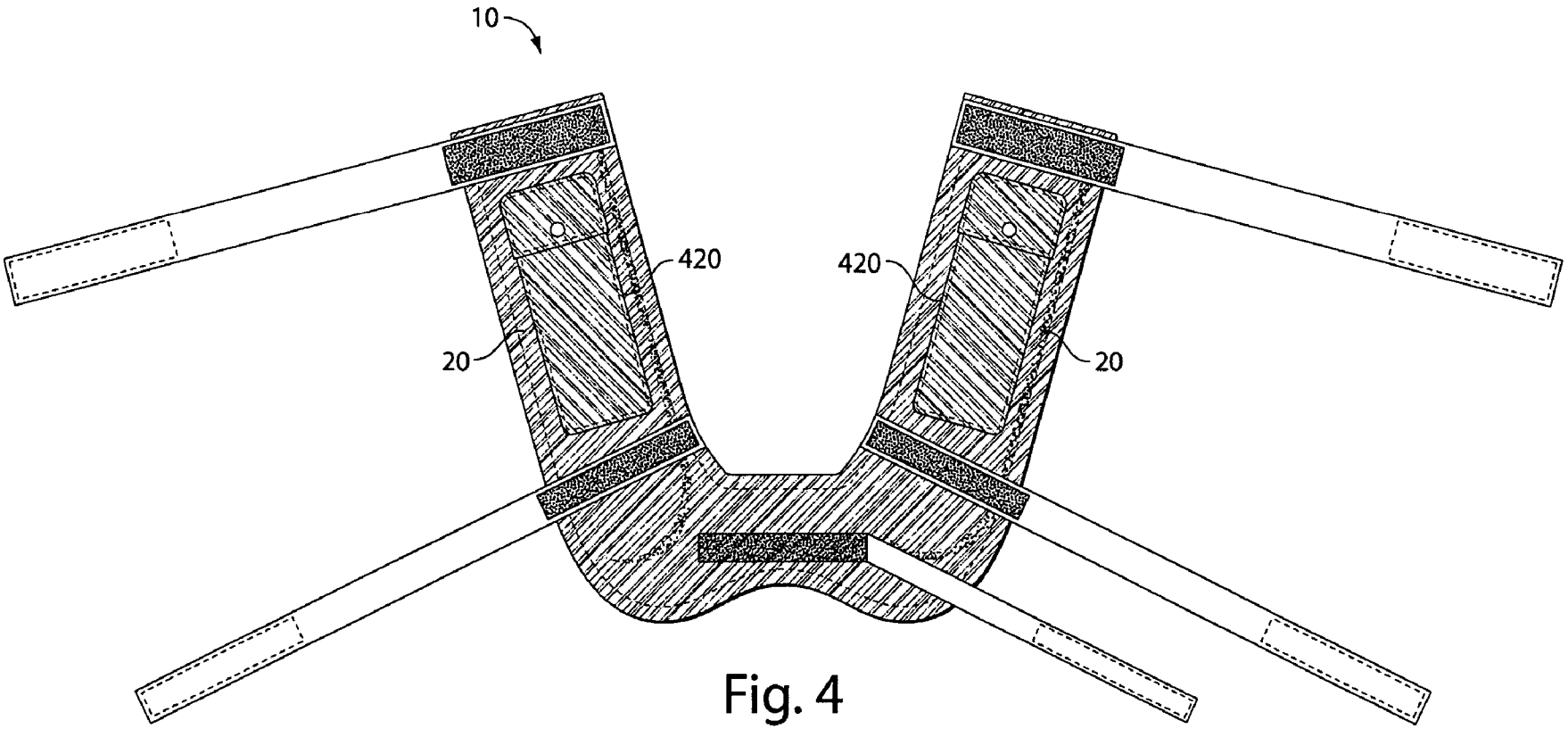
FIG. 4 is a perspective view of a weighted training device of the invention having compartments.

Referring to FIG. 4, the weighted members 20 are shown with one or more optional compartments or pockets 420. The one or more compartments or pockets 420 are made of fabric construction, although other constructions are contemplated and within the scope of the invention. The one or more compartments or pockets 420 are sized to retain one or more weights. The one or more compartments or pockets 420 may include a mechanism by which to secure or enclose the one or more weights, such as a zipper or flap, although other means of securing or enclosing the one or more weights are contemplated and within the scope of the invention. The one or more weights may be removably contained in the one or more compartments or pockets, or may be permanently affixed within the one or more compartments or pockets.

Continuing with reference to FIG. 4, the one or more weights may be of metallic or non-metallic material. The one or more weights may be an aggregate or a solid material. Aggregate materials may include one or more of gravel, metal shot, metal powder, sand, or combinations thereof, although other materials are contemplated and within the scope of the invention. In general, the total weight of the one or more weights may be typically less than or equal to one pound, for example one ounce, two ounces, three ounces, four ounces, five ounces, six ounces, seven ounces, eight ounces, nine ounces, ten ounces, eleven ounces, twelve ounces, thirteen ounces, fourteen ounces, fifteen ounces, and sixteen ounces. In addition, the total weight of the one or more weights may be tailored to the user of the weighted training device. For example, the total weight for a youth user of the weighted training device may be approximately nine ounces; the total weight for a high school or college user of the weighted training device may be approximately thirteen ounces, and the total weight for an adult user of the weighted training device may be in the range of approximately fifteen ounces to approximately sixteen ounces.

Those skilled in the art will recognize, or be able to ascertain using no more than routine experimentation, numerous equivalents to the specific procedures described herein. Such equivalents are considered to be within the scope of the invention. Various substitutions, alterations, and modifications may be made to the invention without departing from the spirit and scope of the invention. Other aspects, advantages, and modifications are within the scope of the invention. The contents of all references, issued patents, and published patent applications cited throughout this application are hereby incorporated by reference. The appropriate components, processes, and methods of those patents, applications and other documents may be selected for the invention and embodiments thereof.

What is claimed is:

1. A lacrosse training device comprising:

a. a first weighted member from two to ten inches in length, wherein the first weighted member is between one ounce and sixteen ounces, and wherein the first weighted member further comprises a first means for attaching the first weighted member to a first sidewall of a lacrosse head frame to permit substantially unobstructed access to an area defined by the lacrosse head frame, b. a second weighted member from two to ten inches in length, wherein the second weighted member is between one ounce and sixteen ounces, and wherein the second weighted member further comprises a second means for attaching the second weighted member to a second sidewall of the lacrosse head frame to permit substantially unobstructed access to an area defined by the lacrosse head frame, c. wherein the means for attachment permits the weighted members to be releasably engaged to the lacrosse head frame and wherein said first and second said weighted members are connected.

2. The lacrosse training device of claim 1, further comprising a third member and a means for attaching the third weighted member to a base of the lacrosse head frame and to the first and second weighted members.

3. The lacrosse training device of claim 1, wherein said training device is of flexible fabric construction.

4. The lacrosse training device of claim 1, wherein said first and second weighted members comprise a compartment retaining a weight.

5. The lacrosse training device of claim 3, wherein the weight of said device is about one pound in total weight.

6. The lacrosse training device of claim 3, wherein the weight of said device is approximately nine ounces in total weight.

7. A lacrosse training device comprising:

a. a first weighted member from two to ten inches in length, wherein the first weighted member is between one ounce and sixteen ounces, and wherein the first weighted member further comprises a first means for attaching the first weighted member to a first sidewall of a lacrosse head frame to permit substantially unobstructed access to an area defined by the lacrosse head frame, b. a second weighted member from two to ten inches in length, wherein the second weighted member is between one ounce and sixteen ounces, and wherein the second weighted member further comprises a second means for attaching the second weighted member to a second sidewall of the lacrosse head frame to c. wherein said training device is of flexible fabric construction, and d. wherein the weighted member comprises an aggregate material selected from the group consisting of gravel, metal shot, metal powder, and sand.

8. The lacrosse training device of claim 7, further comprising a third member and a means for attaching the third weighted member to a base of the lacrosse head frame and to the first and second weighted members.

9. The lacrosse training device of claim 7, wherein said first and second weighted members comprise a compartment retaining a weight.

10. The lacrosse training device of claim 9, wherein the weight of said device is about one pound in total weight.

11. The lacrosse training device of claim 9, wherein the weight of said device is approximately nine ounces in total weight.

12. A lacrosse training device comprising (a) a first means for weighting a first sidewall of a lacrosse stick head frame;

(b) a second means for weighting a second sidewall of a lacrosse stick head frame;

(c) a first means for attaching the first means for weighting to the first sidewall of the lacrosse stick head frame to permit substantially unobstructed access to an area defined by the lacrosse stick head frame; and (d) a second means for attaching the second means for weighting to the second sidewall of the lacrosse stick head frame to permit substantially unobstructed access to an area defined by the lacrosse stick head frame.

* * * * *